US005290362A

United States Patent [19]

Sue

[11] Patent Number: 5,290,362

[45] Date of Patent: Mar. 1, 1994

[54] STRIPPING PROCESS FOR STRIPPING COMPOUNDS OF TITANIUM FROM BASE METALS

[75] Inventor: Jiinjen A. Sue, Carmel, Ind.

[73] Assignee: Praxair S.T. Technology, Inc., Danbury, Conn.

[21] Appl. No.: 997,467

[22] Filed: Dec. 28, 1992

Related U.S. Application Data

[60] Division of Ser. No. 888,450, May 28, 1992, Pat. No. 5,232,619, which is a continuation-in-part of Ser. No. 743,093, Aug. 9, 1991, abandoned, which is a continuation-in-part of Ser. No. 599,833, Oct. 19, 1990, abandoned.

[51] Int. Cl.[5] ..... C11D 7/08; C23G 1/02; C23G 1/14

[52] U.S. Cl. ..... 134/2; 134/3; 134/41; 252/102; 252/136

[58] Field of Search ..... 134/2, 3, 41; 252/102, 252/136

[56] References Cited

U.S. PATENT DOCUMENTS

| | | | |
|---|---|---|---|
| 2,649,361 | 8/1953 | Springer et al. | 41/42 |
| 3,300,349 | 1/1967 | Tershin et al. | 156/22 |
| 3,356,500 | 9/1964 | Autrey | 96/36 |
| 3,649,194 | 3/1972 | Glanville | 23/207.5 |
| 3,903,244 | 9/1975 | Winkley | 423/272 |
| 4,022,703 | 5/1977 | Bakes et al. | 252/100 |
| 4,410,396 | 10/1983 | Somers et al. | 156/664 |
| 4,459,216 | 7/1984 | Nakazato et al. | 252/79 |
| 4,545,918 | 10/1985 | Pralus | 252/142 |
| 4,554,049 | 11/1985 | Bastenbeck | 156/656 |
| 4,600,443 | 7/1986 | Basalyk et al. | 134/3 |
| 4,608,091 | 8/1986 | Sullivan | 134/3 |
| 4,619,707 | 10/1986 | Mirschmeier et al. | 134/3 |
| 4,707,191 | 11/1987 | Martinou et al. | 134/3 |
| 4,746,369 | 5/1988 | Sullivan et al. | 134/3 |
| 4,770,808 | 9/1988 | McDonogh et al. | 252/186.29 |
| 4,950,359 | 8/1990 | Parissis et al. | 134/1 |
| 4,970,094 | 11/1990 | Byrd | 204/290 R |

FOREIGN PATENT DOCUMENTS

| | | |
|---|---|---|
| 1295954 | 10/1970 | United Kingdom . |
| 1407269 | 11/1972 | United Kingdom . |

*Primary Examiner*—R. Bruce Breneman
*Assistant Examiner*—Zeinab El-Arini
*Attorney, Agent, or Firm*—Cornelius F. O'Brien

[57] ABSTRACT

An aqueous stripping solution and method for selectively removing a titanium compound from a base metal. The aqueous solution contains a source of hydrogen peroxide, an alkali source of hydroxyl ions and an acid with the components in a concentration such that the pH of the solution is above 8.

9 Claims, 5 Drawing Sheets

○ $H_2O$-1.32 mole/L $H_2O_2$-1.46 mole/L $NH_4OH$ -0.16 mole/L $H_3C_6H_5O_7$

△ $H_2O$-1.32 mole/L $H_2O_2$-1.09 mole/L $NH_4OH$ -0.16 mole/L $H_3C_6H_5O_7$

STRIPPING PROCESS FOR STRIPPING COMPOUNDS OF TITANIUM FROM BASE METALS

This application is a division of prior U.S. application Ser. No. 07/888,450, filing date: 05/28/92, now U.S. Pat. No. 5,232,619, which is a continuation-in-part of application Ser. No. 07/743,093 Filing Date: 8/9/91 now abandoned, which is a continuation-in-part of application Ser. No. 07/599,833 filed 10/19/90, now abandoned.

FIELD OF THE INVENTION

This invention relates to an aqueous stripping solution for selectively removing a titanium compound, such as TiN or $TiB_2$, from a solid base metal without chemically attacking the solid base metal and to an accompanying process for stripping compounds of titanium from base metals.

BACKGROUND OF INVENTION

High performance components in aircraft engine turbomachines such as compressor blades, bearings and gears are typically coated with a titanium metal compound such as TiN to improve their wear characteristics and to provide erosion protection. The engine parts are cast or otherwise molded or machined from superalloys,- stainless steels or alloy steels and represent very expensive precision components. Removal of the coating from the underlying base metal is necessary if a defect is discovered in the coating and/or for restoring worn components. It is essential to strip the protective coating from the base metal without suffering any detrimental attack to the underlying base metal.

To selectively strip a titanium compound such as TiN from a solid base metal composed of a superalloy, stainless steel or alloy steel without chemically attacking the base metal is particularly difficult when both the base metal and coating have a high corrosion resistance characteristic. Stripping is even more difficult when the corrosion resistance of the coating is equal to or greater than the corrosion resistance of the substrate.

Although, stripping solutions containing hydrogen peroxide are known there is no known aqueous based stripping solution using hydrogen peroxide which will permit the removal of a coating of a titanium compound from a solid base metal composed of a superalloy, stainless steel or alloy steel without causing detrimental attack to the underlying base metal. A chemical stripping solution comprising hydrogen peroxide is described in U.S. Pat. Nos. 4,554,049, 4,410,396 and 4,545,918 respectively. The stripping solutions disclosed in these patents are either unable to strip compounds of titanium from base metals composed of superalloys stainless steels and alloy steels or will actively attack both the titanium compound coating and the base metal.

SUMMARY OF THE INVENTION

The process of the present invention for stripping a coating of a titanium compound from an underlying base metal without suffering chemical attack to the base metal comprises the steps of:

immersing the base metal and coating into an aqueous solution containing a source of hydrogen peroxide, an alkali source of hydroxyl ions, and an acid, maintaining the solution temperature between 25° C. and 85° C. and adjusting the molar ratio of the components to cause the pH of the aqueous solution to be above a pH of 8.

The stripping composition of the present invention comprises an aqueous solution including an alkali source of hydroxyl ions, a source of hydrogen peroxide and an acid with the constituents of the solution in a concentration such that the pH of the solution is above 8.

DETAILED DESCRIPTION OF THE INVENTION

Figure 1:
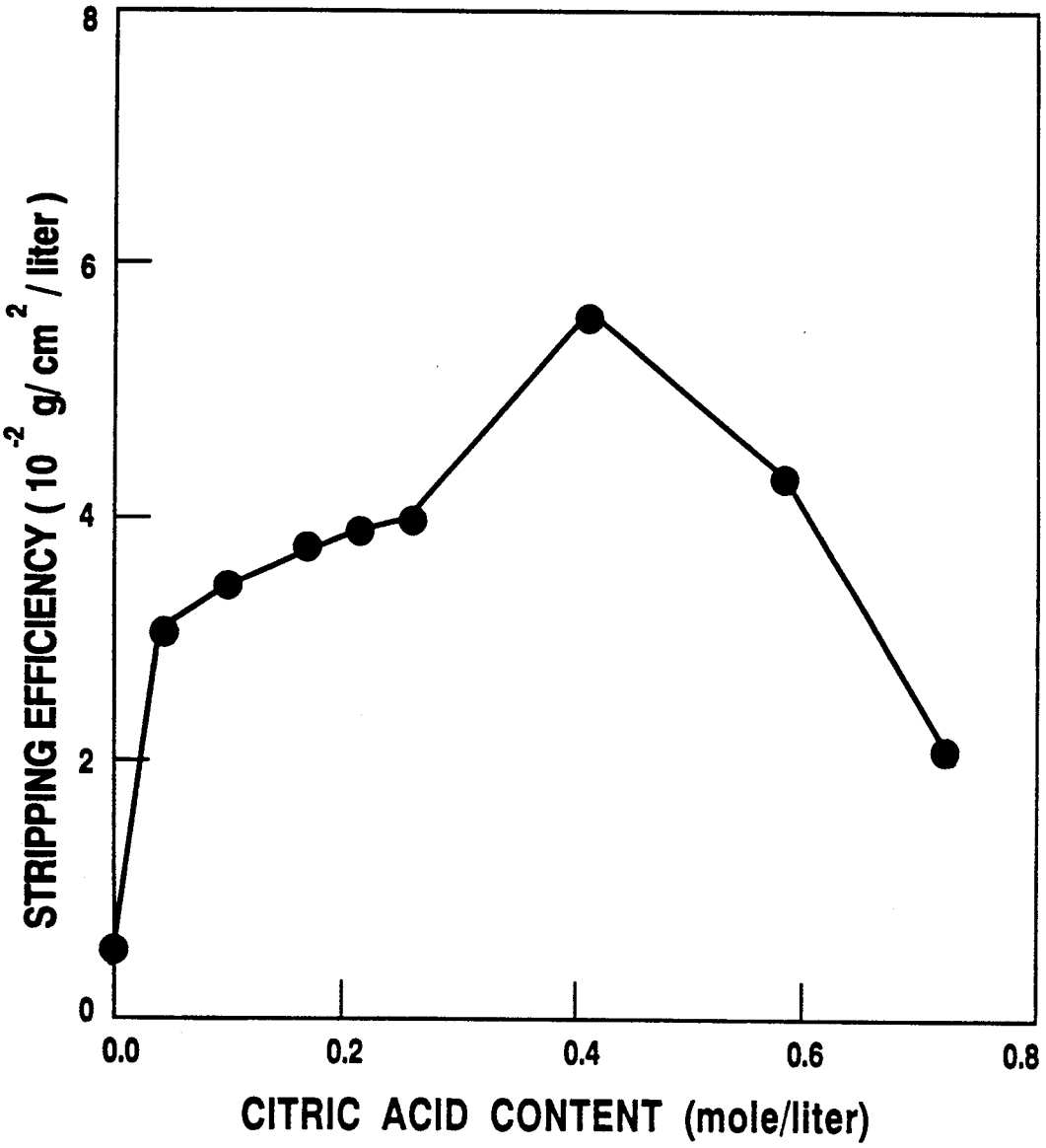
FIG. 1 is a plot of stripping efficiency versus the content of the preferred acid in mole per liter for removing a TiN coating from an Inconel 718 base metal.

Essentially any coating composition of a titanium compound can be removed from any base metal substrate by the process of the present invention without detrimentally attacking the base metal. The invention is particularly suited to the removal of TiN or $TiB_2$ from a base metal composed of stainless steels, superalloys or alloy steels.

The stripping solution of the present invention comprises the following three components: a source of hydrogen peroxide, an alkaline source of hydroxyl ions and a suitable acid in various proportions to cause the pH of the solution to be above 8 without corroding the substrate. The stripping solution is prepared by first combining the source of hydrogen peroxide with water. The source of hydrogen peroxide should be present in a minimum concentration of 0.29 mole per liter and in a preferred concentration range of between 0.29 to about 4.71 mole per liter (mole/L). Any source of hydrogen peroxide such as a perborate, as is well known to those skilled in the art, may be used. Other compounds which readily dissociate into hydrogen peroxide upon contact with water are-also suitable. The alkali source of hydroxyl ions (OH) is then added to the solution. The hydroxyl ion is preferably added in combination with ammonium ions through the addition of ammonium hydroxide ($NH_4OH$). The source of hydroxyl ions should be present in the stripping solution in a concentration of at least 0.29 mole/L and preferably between 0.29 mole/L and 3.23 mole/L. An acid must also be present in the solution at a concentration of 0.026 mole/L and preferably between 0.026 mole/L and 0.76 mole/L. Any acid which will not corrode the base metal may be used, preferably an organic carboxyl or carboxyl-hydroxyl group acid such as lactic acid, oxalic acid, tartaric acid, formic acid, propionic acid or citric acid. Alternatively, a diluted inorganic acid such as, for example, acetic acid, nitric acid, hydrochloric acid and sulfuric acid may also be used provided it will not chemically attack the base metal and is low enough in concentration to maintain the solution pH above 8.

The pH of the stripping solution is critical to the present invention and must be above pH 8 to be effective. The preferred pH range is between pH 9–14 with a pH range of 10–12 being optimum. The pH of the solution may be controlled by adjusting the concentration of alkali, peroxide and organic acid relative to one another provided each is held to a concentration within the preferred range. Additionally, other alkali ions such as sodium or potassium ions may be added to the stripping solution by the addition of NAOH and/or KOH to establish the desired mole concentration and/or to adjust the pH of the solution.

The effectiveness of the stripping solution of the present invention is determined by the efficiency in which the titanium compound coating is removed from the substrate without suffering any deleterious effect on the base metal. A minimum stripping efficiency of $1\times10^{-2}$g/cm$^2$/L and preferably above $2\times10^{-2}$g/CM$^2$/L is necessary for the stripping solution to be acceptable for commercial practice. The stripping efficiency is determined based on total weight loss of the coating per unit coating surface area for a given volume of stripping solution over a time period until the solution is considered inactive.

Experiments were conducted using numerous aqueous compositions all containing various proportions of hydrogen peroxide, an acid and an alkali source of hydroxyl ions. The following tables I, II, III and IV identify the different solution compositions all of which had no deleterious effect on the base metal. All of the tests shown in the Tables I, II, III and IV were carried out by immersing a TiN coated Inconel 718* coupon (1.5×25×50 mm) into the test stripping solution at between 60° and 85° C.

TABLE I

Effect of Citric Acid Content ($H_3C_6H_5O_7$) on Stripping Efficiency

| Solution | Composition Mole/L | | | | PH | Stripping Efficiency ($10^{-2}$ g/cm$^2$/L) |
|---|---|---|---|---|---|---|
| | $H_2O$ | $H_2O_2$ | $NH_4OH$ | $H_3C_6H_5O_7$ | | |
| 1 | bal. | 1.32 | 1.09 | 0 | 10 | 0.38 |
| 2 | bal. | 1.32 | 1.09 | 0.05 | 10 | 3.1 |
| 3 | bal. | 1.32 | 1.09 | 0.10 | 10 | 3.4 |
| 4 | bal. | 1.32 | 1.09 | 0.16 | 10 | 3.8 |
| 5 | bal. | 1.32 | 1.09 | 0.21 | 10 | 4.0 |
| 6 | bal. | 1.32 | 1.09 | 0.26 | 10 | 4.1 |
| 7 | bal. | 1.32 | 1.09 | 0.42 | 9 | 5.7 |
| 8 | bal. | 1.32 | 1.09 | 0.59 | 9 | 4.4 |
| 9 | bal. | 1.32 | 1.09 | 0.73 | 8.5 | 2.0 |

*Inconel 718 is a registered trademark of the International Nickel Corporation.

Table I should be read in conjunction with FIG. 1, which is based on the data of Table I, showing the effect of citric acid on the stripping efficiency of the solution. Citric acid is the preferred acid component although any of the other acids, as heretofore described, may be substituted for citric acid at equivalent concentration or equivalent pH levels to produce substantially equivalent results. The stripping efficiency increases monotonically with increasing concentration of citric acid provided the pH level is above 8.5. The concentration of hydrogen peroxide and the alkali component were held constant. It was determined from experimentation that the presence of a minimum concentration of acid was necessary to stabilize the solution and to permit the stripping efficiency to exceed the minimum level. The concentration of citric acid should be above at least about 0.026 mole/L and preferably above 0.052 mole/L. The maximum concentration of citric acid is approximately 0.76 mole/L. Upon exceeding the maximum concentration the pH of the solution drops to below 8.5 which reduces the stripping efficiency below the effective minimum level.

TABLE II

Effect of $NH_4OH$ Content on Stripping Efficiency

| Solution | Composition Mole/L | | | | PH | Stripping Efficiency ($10^{-2}$ g/cm$^2$/L) |
|---|---|---|---|---|---|---|
| | $H_2O$ | $H_2O_2$ | $NH_4OH$ | $H_3C_6H_5O_7$ | | |
| 10 | bal. | 1.32 | 0 | 0.16 | 2 | 0.39 |
| 11 | bal. | 1.32 | 0.37 | 0.16 | 10 | 3.0 |
| 4 | bal. | 1.32 | 1.09 | 0.16 | 10 | 3.8 |
| 12 | bal. | 1.32 | 1.46 | 0.16 | 10 | 4.2 |
| 13 | bal. | 1.32 | 1.80 | 0.16 | 10 | 4.0 |
| 14 | bal. | 1.32 | 2.51 | 0.16 | 11 | 5.3 |
| 15 | bal. | 1.32 | 3.23 | 0.16 | 11 | 5.1 |

Figure 2:
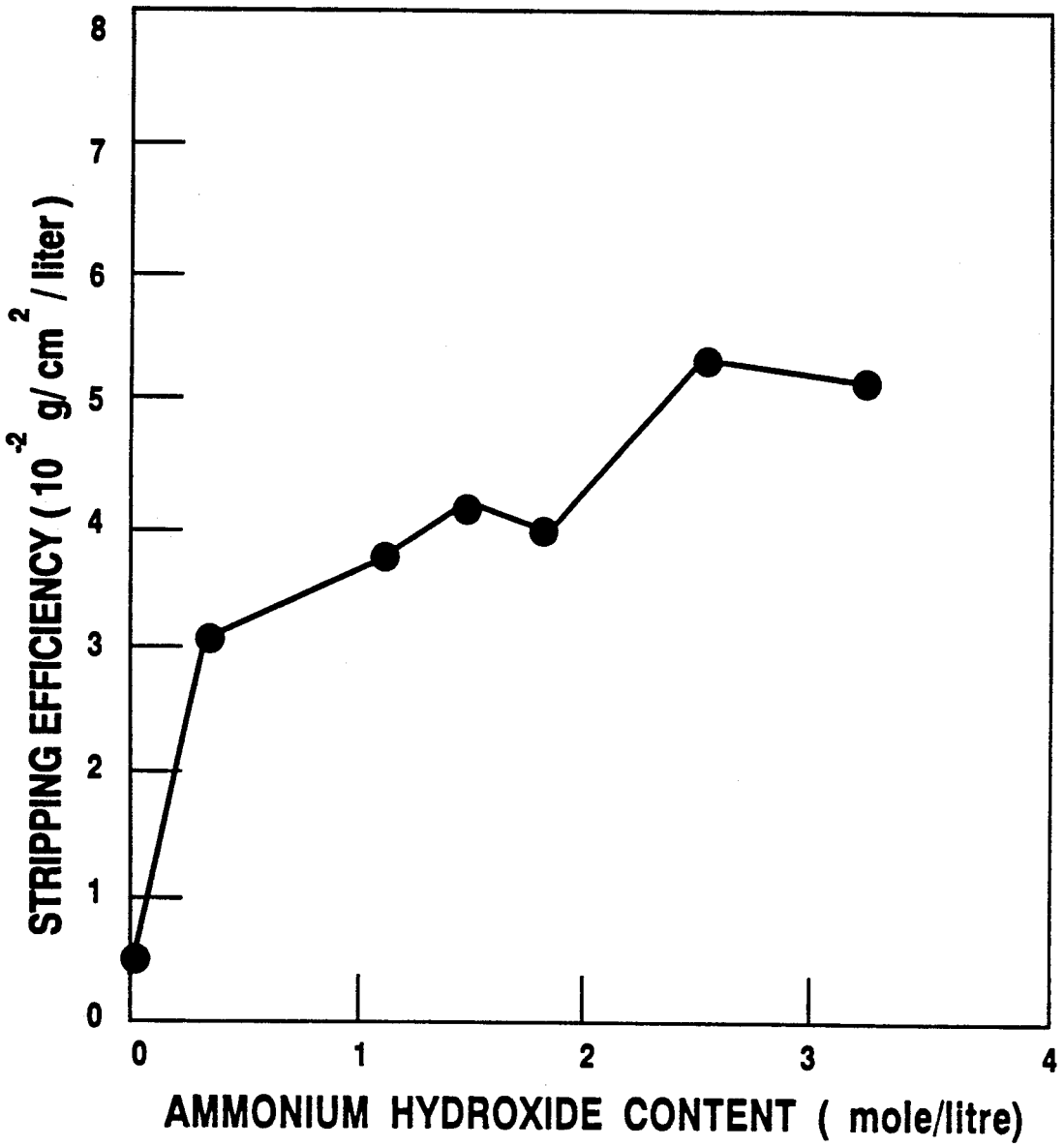
FIG. 2 is a plot similar to that of FIG. 1 showing stripping efficiency as a function of the content of $NH_4OH$ in mole per liter in the stripping solution of the present invention.

Table II should be read in conjunction with FIG. 2 which is based on the data of Table II and shows the effect of varying the concentration of ammonium hydroxide ($NH_4OH$) in the stripping solution. Ammonium hydroxide is the preferred alkali source. The concentration level of citric acid and peroxide were held constant while adjusting the concentration of $NH_4OH$. From Table II and FIG. 2 it is apparent that the stripping solution does not function effectively until the concentration of $NH_4OH$ is raised to a minimum level of about 0.29 mole/L at a pH of 8 or higher. The latter was confirmed by the data shown in Table IV as will be discussed in greater detail later in the specification.

TABLE III

Effect of $H_2O_2$ Content on Stripping Efficiency

| Solution | Composition Mole/L | | | | PH | Stripping Efficiency ($10^{-2}$g/cm$^2$/L) |
|---|---|---|---|---|---|---|
| | $H_2O$ | $H_2O_2$ | $NH_4OH$ | $H_3C_6H_5O_7$ | | |
| 16 | bal. | 0.44 | 1.09 | 0.16 | 9 | 1.9 |
| 17 | bal. | 0.88 | 1.09 | 0.16 | 9 | 3.6 |
| 4 | bal. | 1.32 | 1.09 | 0.16 | 10 | 3.8 |
| 18 | bal. | 2.65 | 1.09 | 0.16 | 10 | 6.3 |
| 19 | bal. | 4.41 | 1.09 | 0.16 | 10 | 6.9 |
| 20 | bal. | 2.65 | 2.17 | 0.16 | 11 | 6.2 |

Figure 3:
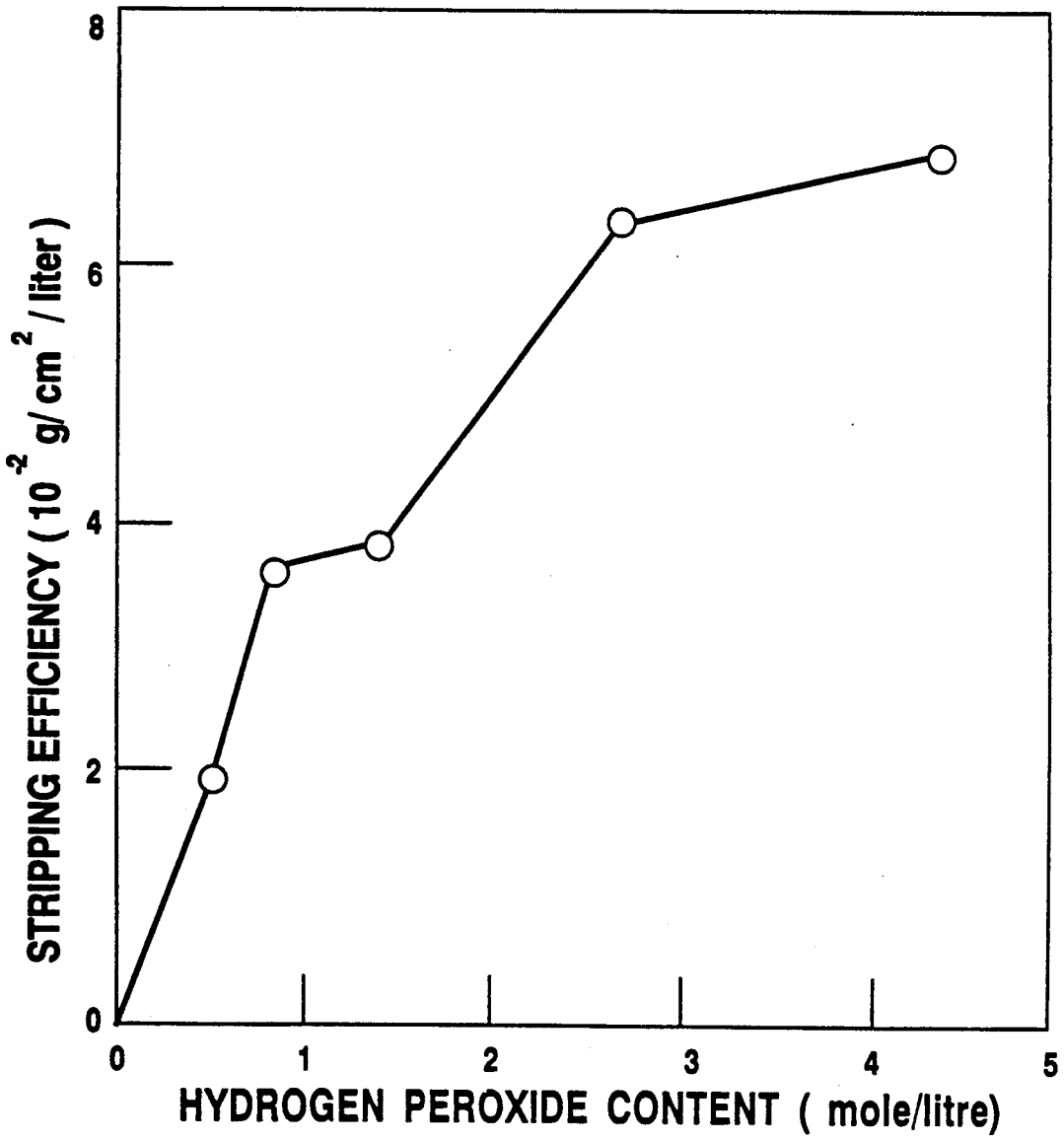
FIG. 3 is another plot similar to that of FIG. I of stripping efficiency as a function of the content of hydrogen peroxide in mole per liter in the stripping solution of the present invention.

Table III should be read in conjunction with FIG. 3 from which it is apparent that the stripping efficiency directly increases with increasing concentrations of hydrogen peroxide up to about 2.94 mole/L at which concentration the stripping efficiency of the solution levels off. Accordingly, although the hydrogen peroxide concentration may be further increased the maximum level should be about 4.71 mole/L above which, for practical considerations, there is a negative incentive to further raise the hydrogen peroxide concentration. The minimum concentration of hydrogen peroxide is about 0.29 mole/L and preferably above 0.59 mole/L.

Figure 4:
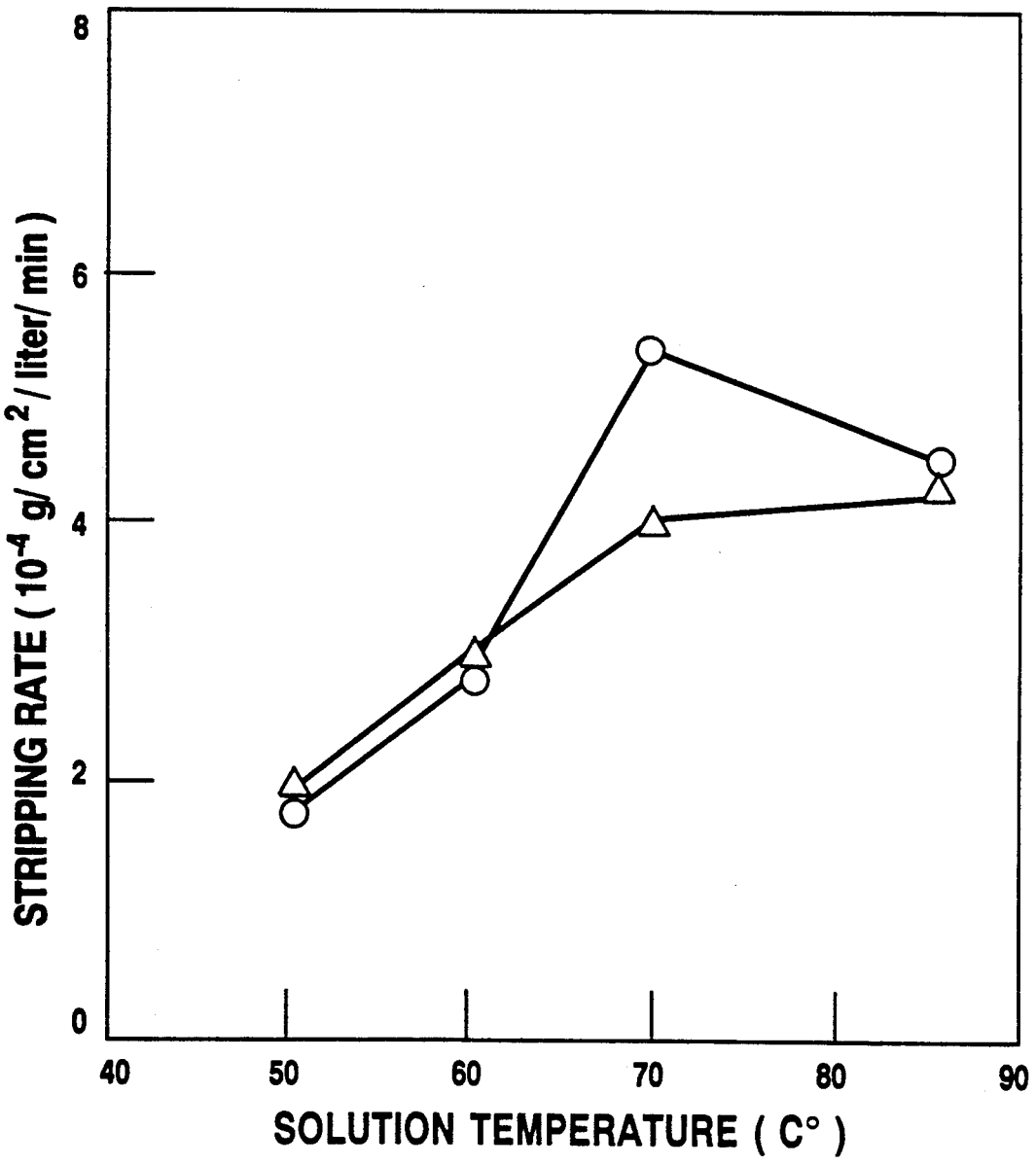
FIG. 4 is a plot of the solution stripping rate for stripping TiN from an Inconel 718 coupon as a function of the solution operating temperature.

Typically the temperature of the solution has an influence on the stripping rate and efficiency. The reactivity of the solution increases with increasing operating temperature and the solution life decreases with increasing operation temperature. Accordingly, to determine the optimum solution temperature two test solutions were prepared using a different peroxide to alkali molar ratio at a constant acid concentration. The stripping rate was evaluated as a function of the operating temperature as shown in FIG. 4. The composition of the two test solutions were as follows:

Solution 12. 1.32 mole/L $H_2O_2$+1.46 mole/L $NH_4OH$+0.16 mole/L $H_3C_6$ $H_5O_7$ balance water (marked "O" in FIG. 4).

Solution 4. 1.32 mole/L $H_2O_2$+1.09 mole/L $NH_4OH$+0.16 mole/L $H^3C_6$ $H_5O_7$ balance water (marked "Δ" in FIG. 4).

The stripping rate is expressed in terms of the total weight loss (in grams) of the coating per unit area (in $cm^2$) per unit volume (in liters) per unit time (in minutes). As shown in, FIG. 4 the optimum stripping rate is realized at a solution temperature exceeding 50° C. and preferably between 60° C. and 85° C.

Figure 5:
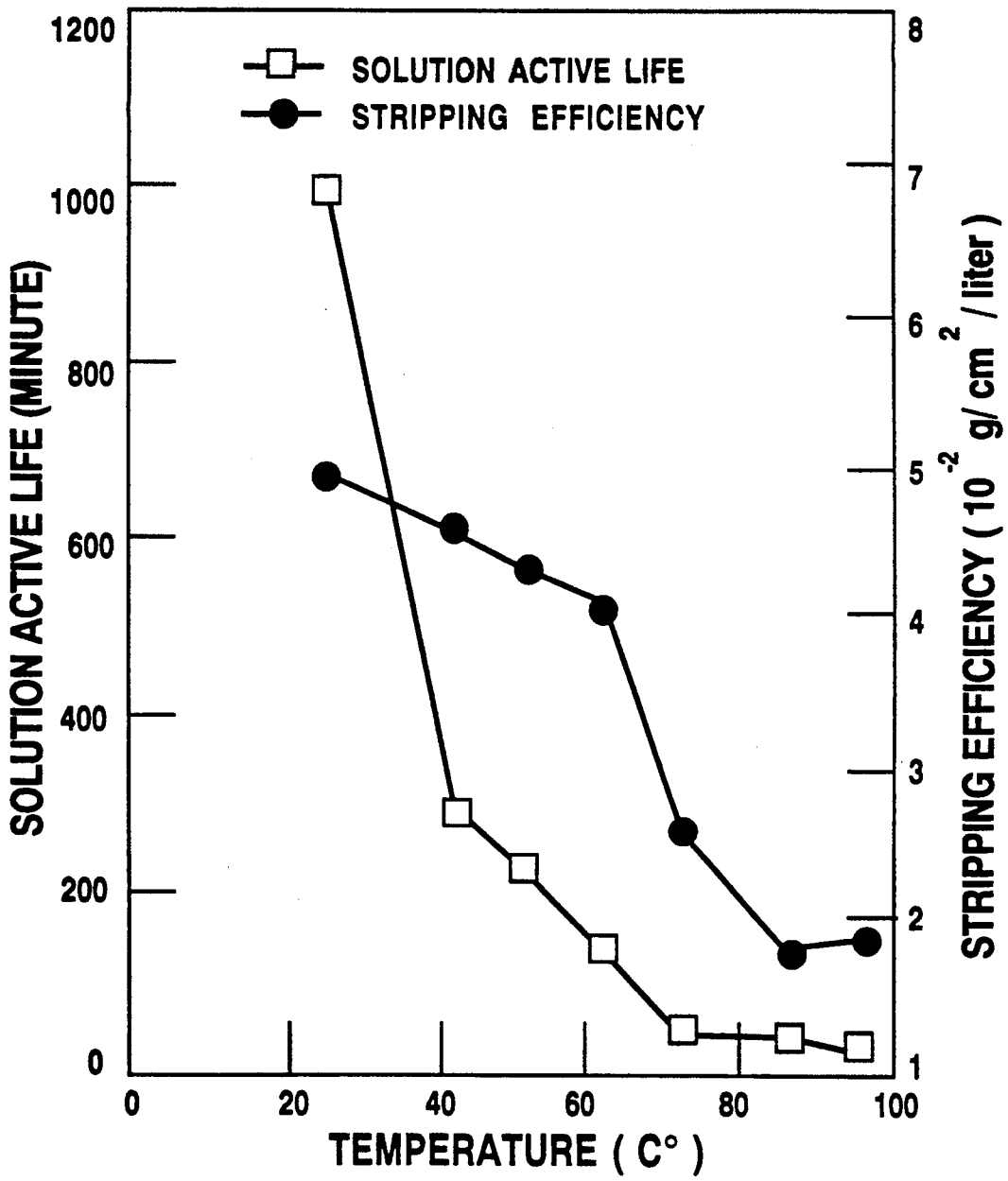
FIG. 5 is a plot of the solution active life of a preferred solution composition for removing TiN from Inconel 718 base metal substrates and the stripping efficiency as a function of temperature.

Although the optimum solution temperature is above 50° C. the solution may be operated at a temperature within a wide range extending from about 25° C. to about 95° C. as is evident from FIG. 5 which is a plot of the solution active life in minutes as well as stripping efficiency against temperature. A preferred solution of $H_2O$+1.32 mole/L $H_2O_2$+1.09 mole/L $NH_4OH$+0.16 mole/L citric acid was used to develop the plot. The solution active life was found to decrease exponentially with increasing temperature from about 1000 minutes at 25° C. to about 24 minutes at about 95° C. The stripping efficiency also decreases rapidly with increasing temperature. At higher operating temperatures of above about 85° C. the solution active life is simply too short for any practical commercial use. FIG. 5 should be evaluated in conjunction with FIG. 4 which substantiates that the stripping rate is highest above 50° C. Accordingly from both FIGS. 4 and 5 a wide operating solution temperature of between 25° C. to 85° C. is practical although the highest stripping rate occurs above between 50° C. and 85° C. with 60° C.-80° C. being the preferred range for optimum stripping with a reasonable solution active life.

The following Table IV is a compilation of the data obtained using various alkali ammonium compounds and NAOH at different pH levels for comparison with the results of Table II on the effect of stripping efficiency for the various test solutions.

From the above Table IV it is apparent that a pH above 8 is necessary for the solution to provide an effective stripping efficiency and that ammonium compounds other than $NH_4OH$ do not produce effective stripping efficiencies unless combined with $NH_4OH$ or another source of hydroxyl ions such as NAOH. However, it is clear from all of the test data that $NH_4OH$ is the preferred alkali source. The effective concentration for the three critical components, viz., a source of hydrogen peroxide, an alkali source of hydroxyl ions and acid is 0.29 mole/L to 4.71 mole/L, 0.29 mole/L to 3.23 mole/L and 0.026 mole/L to 0.76 mole/L, respectively. For the preferred components $H_2O_2$; $NH_4OH$ and citric acid the preferred concentration is 0.59 mole/L to 4.71 mole/L, 0.37 mole/L to 3.23 mole and 0.05 mole/L to 0.66 mole/L, respectively.

Although the base metal in the test coupons were all of Inconel 718 other coupons including TiN coated stainless steels such as AISI440C and AISI 17-4 PH and alloy steels such as M50, M50NIL and Pyrowear 53 were tested using the preferred stripping solution. All demonstrated similar behavior to the TiN coated Inconel 718 coupons with no deleterious effect on the base metal.

The hydrogen peroxide component in the stripping solution of the present invention may be generated in situ from any source of peroxide which dissociates in water to form hydrogen peroxide such as a perborate, e.g. sodium perborate tetrahydrate ($NaBO_3o4H_2O$) or any other know peroxide compound which will readily dissociated into hydrogen peroxide in the presence of water at atmospheric pressure and within the operating temperatures of the present invention. Ammonium peroxydisulfate ($(NH_4)_2S_2O_8$) is not a suitable source of hydrogen peroxide for the present invention as is evident from the following Table V despite the fact that ammonium peroxydisulfate is used to commercially produce hydrogen peroxide by hydrolysis at reduced pressure and elevated temperature.

In accordance with the following Table V TiN coated Inconel 718 coupons (1.5×25×50 mm) were immersed into separate peroxide containing solutions with a specified pH of above 8 and at temperatures of between 60*C and 65*C to evaluate the stripping effectiveness of the solutions with the different sources of peroxide.

TABLE IV

Effects of Composition and pH Value on Stripping Efficiency

| Solution | Composition Mole/L | | | | | | | | pH | Stripping Efficiency ($10^{-2}$ g/cm²/L) |
|---|---|---|---|---|---|---|---|---|---|---|
| | $H_2O$ | $H_2O_2$ | $NH_4OH$ | $H_3C_6H_5O_7$ | NaOH | $NH_4HCO_3$* | $(NH_4)_2SO_4$** | $(NH_4)_2C_4H_4O_6$*** | | |
| 21 | bal. | 1.32 | — | 0.16 | 1.07 | — | — | — | 13 | 0.70 |
| 22 | bal. | 1.32 | — | 0.16 | 1.64 | — | — | — | 14 | 1.1 |
| 23 | bal. | 1.32 | — | 0.16 | 4.11 | — | — | — | 14 | 2.1 |
| 24 | bal. | 1.32 | 0.51 | 0.10 | 1.93 | — | — | — | 14 | 2.1 |
| 25 | bal. | 1.32 | — | 0.10 | — | 1.01 | — | — | 8 | 0.70 |
| 26 | bal. | 1.32 | — | — | — | 1.27 | — | — | 8 | 0.65 |
| 27 | bal. | 1.32 | — | 0.05 | — | 1.27 | — | — | 8 | 0.73 |
| 28 | bal. | 1.32 | — | 0.10 | — | — | 0.61 | — | 2 | 0.47 |
| 29 | bal. | 1.32 | — | 0.10 | — | — | — | 0.43 | 4 | 0.52 |
| 30 | bal. | 1.32 | — | — | 9.11 | — | 0.43 | — | 7 | 0.35 |
| 31 | bal. | 1.32 | — | — | 6.11 | — | — | 0.36 | 8 | 1.8 |

*Ammonium Bicarbonate
**Ammonium Sulfate
***Ammonium Tartrate

TABLE V

| Solution | $H_2O$ | $H_2O_2$ | $NaBO_3.4H_2O$ | $(NH_4)_2S_2O_8$ | $NH_4OH$ | $NH_4Cl$ | $CH_3OH$ | $H_3C_6H_5O_7$ | pH | Stripping Efficiency ($10^{-2}$ g/cm²/L) |
|---|---|---|---|---|---|---|---|---|---|---|
| 4 | Bal. | 1.32 | — | — | 1.09 | — | — | 0.16 | 10 | 3.8 |

TABLE V-continued

| Solution | $H_2O$ | $H_2O_2$ | $NaBO_3.4H_2O$ | $(NH_4)_2S_2O_8$ | $NH_4OH$ | $NH_4Cl$ | $CH_3OH$ | $H_3C_6H_5O_7$ | pH | Stripping Efficiency ($10^{-2}$ g/cm²/L) |
|---|---|---|---|---|---|---|---|---|---|---|
| 32 | Bal. | — | 0.65 | — | — | — | — | 0.16 | 8 | 0.7 |
| 33 | Bal. | — | 0.65 | — | 1.09 | — | — | 0.16 | 11 | 1.6 |
| 34 | Bal. | — | — | 1.05 | 2.54 | 0.66 | 0.13 | — | 9-10 | 0 |
| 35 | Bal. | — | — | 0.66 | 1.09 | — | — | 0.16 | 9-10 | 0 |
| 36 | Bal. | 1.32 | — | — | 1.09 | 0.5 | 0.13 | — | 9-10 | 1.2 |

As is evident from the above table no stripping action was observed in the solutions 34 and 35 containing ammonium peroxydisulfate and no weight loss was found on the test coupons. The solutions 32 and 33 with sodium perborate tetrahydrate were capable of stripping the TiN coating from an Inconel 718 substrate but at a reduced stripping efficiency. This is in sharp contrast to the effect of an otherwise identical stripping solution composition containing hydrogen peroxide.

Tables V and VI show the results of corrosion on the base metal when the acid component in the stripping solution contains the $Cl^-$ ion. In solution No. 34 and 36, $NH_4Cl$ and $CH_3OH$ were used instead of an organic acid and in solutions No. 37–40 HCl was used. Both TiN coated Inconel 718 and 410 stainless steel coupons (1.5×25×50 mm in size) were immersed into the solution No. 36 and only 410 stainless steel exhibited corrosion-attack due to the presence of the $Cl^-$ ion from the $NH_4Cl$ solution. In the tests in the following Table VI HCl was used as the acid component to strip TiN from different substrate materials at different concentration levels. Accordingly, the chloride concentration levels that cause pitting vary with the substrate material composition. If an acid containing the chloride ion is used in the stripping solution, the concentration of acid should be determined according to the substrate material used.

TABLE VI

| Solution | Composition (Mole/L) $H_2O$ | $H_2O2$ | $NH_4OH$ | HCl | Substrate Material | Comments |
|---|---|---|---|---|---|---|
| 37 | Bal- | 1.32 | 1.09 | 0.12 | M50 Steel | Pitting corrosion attack |
| 38 | Bal. | 1.32 | 1.09 | 0.35 | 410 SS | Pitting corrosion attack |
| 39 | Bal. | 1.32 | 1.09 | 0.35 | Inconel 718 | No corrosion attack |
| 40 | Bal- | 1.32 | 1.09 | 1.16 | Inconel 718 | Pitting corrosion attack |

Experiments were undertaken to determine the effectiveness of various hydroxides and organic acids in the peroxide stripping solution of the present invention for stripping a titanium compound from a base metal of a superalloy, stainless steel or alloy steel. The first series of solutions 45 to 50 contained 1.32 mole/L $H_2O_2$, 0.16 mole/L citric acid and 1.09 mole/L of a hydroxide selected from the group as identified in Table VII. The hydroxides include the metallic hydroxides LiOH, NaOH, KOH, MgOH and CaOH and the non-metallic hydroxide $NH_4OH$. The second series of solutions 51 to 56 were composed of 1.32 mole/L $H_2O_2$, 1.09 mole/L $NH_4OH$, and 0.16 mole/L of the various organic acids as identified in Table VIII. The organic acids include acetic acid, lactic acid, oxalic acid, tartaric acid, citric acid, and gluconic acid. A TiN coated AISI 410 SS coupon (−1.5×25×50 mm³) was immersed in the above mentioned solutions at 60° C. The stripped surface and the uncoated area of the AISI 410 SS coupon, which was also exposed to a stripping solution, were examined in a scanning electron microscope.

TABLE VII

Effects of Hydroxide on Stripping Rate and Efficiency

| Solution | Hydroxide in Solution | pH | Stripping Efficiency ($10^{-2}$ g/cm²/L) | Stripping Rate ($10^{-4}$ g/cm²/L/min) |
|---|---|---|---|---|
| 45 | LiOH | 9 | 0.97 | 0.24 |
| 46 | NaOH | 11 | 0.55 | 0.42 |
| 47 | KOH | 11 | 0.48 | 0.38 |
| 48 | MgOH | 10 | 0 | 0 |
| 49 | CaOH | 9 | 0 | 0 |
| 50 | $NH_4OH$ | 10 | 5.31 | 5.58 |

Table VII shows the effects of the different hydroxides on stripping efficiency and stripping rate. Solutions 48 and 49 with MgOH and CaOH, respectively, were ineffective in stripping the TiN coating from AISI 410 SS base metal. Solution 50 containing the non-metallic hydroxide $NH_4OH$ had a stripping efficiency of 5 to 10 times that of solutions 45, 46, and 47, which contain alkali metal hydroxides LiOH, NaOH, and KOH respectively. The stripping rate of solution 50 is 13 to 23 times that of solutions 45, 46, and 47. Clearly, the stripping efficiency for the solutions containing a metallic hydroxide is too low to be effectively used for commercial application. Furthermore, the uncoated area of the AISI 410 SS coupon showed minor chemical etching attack after removing a relatively small amount of the coating in solutions 45, 46, and 47. Due to such a slow stripping rate, an accumulative damage in the base metal from chemical etching attack can be substantial when the coating is completely removed. A non-metallic hydroxide, preferably ammonium hydroxide ($NH_4OH$) is accordingly essential to achieve the minimum level of stripping efficiency required for commercial application; although, a metallic hydroxide, such as NaOH, may also be added to the solution to control the pH of the stripping solution. Any non-metallic hydroxide may be used other than $NH_4OH$ provided it will dissolve in water.

TABLE VIII

Effects of Organic Acids on Stripping Rate and Efficiency

| Solution | Organic Acid in Solution | Components in Organic Acid —COOH Group | —OH Group | pH | Stripping Efficiency ($10^{-2}$ g/cm²/L) | Stripping Rate ($10^{-4}$ g/cm²/L/min) |
|---|---|---|---|---|---|---|
| 51 | Acetic | 1 | 0 | 10–11 | 1.01 | 1.68 |
| 52 | Lactic | 1 | 1 | 10 | 1.51 | 3.02 |
| 53 | Gluconic | 1 | 5 | 11 | 1.20 | 0.48 |
| 54 | Oxalic | 2 | 0 | 10–11 | 1.58 | 2.63 |
| 55 | Tartaric | 2 | 2 | 10–11 | 2.97 | 3.49 |
| 56 | Citric | 3 | 1 | 10 | 5.31 | 5.58 |

Typically, an organic acid contains a carboxyl or a carboxyl-hydroxyl group. Table VIII shows that stripping efficiency and stripping rate increase for organic acids containing larger numbers of —COOH groups (carboxyl groups). The hydroxyl (—OH) group also appeared to have a positive effect on the stripping efficiency, as demonstrated in solutions 51 and 52 as well as solutions 54 and 55. However, the AISI 410 SS surface which was exposed to a stripping solution containing an organic acid with a —OH group showed an etching appearance in the scanning electron microscope. Furthermore, excessive numbers of the —OH group as in solution 53 substantially reduced the stripping rate. Based on the results of Table VIII, the preferred organic acid should contain an equal or larger number of carboxyl (—COOH) groups as compared to the (—OH) group. The most preferred organic acids are citric acid and tartaric acid.

What I claim is:

1. A process for stripping a coating of a titanium compound selected from the group consisting of titanium nitride compounds and titanium boride compounds from a base metal of a super alloy, stainless steel or alloy steel without suffering chemical attack to the base metal comprising the steps of:

immersing the base metal and coating into an aqueous solution containing hydrogen peroxide or a compound which dissociated into hydrogen peroxide in water, an alkali source of hydroxyl ions, and an acid, maintaining the solution temperature between about 25° C. and 85° C. and maintaining the pH of the aqueous solution at a pH of above at least 8.

2. A process as defined in claim 1 wherein the minimum concentration of hydrogen peroxide, said source of hydroxyl ions and said acid is 0.29 mole/L, and 0.026 mole/L respectively.

3. A process as defined in claim 2 wherein said alkali source further comprises ammonium ions.

4. A process as defined in claim 3 wherein said acid is an organic acid selected from the carboxyl group or carboxyl-hydroxyl group.

5. A process as defined in claim 4 wherein the concentration of hydrogen peroxide, said alkali source and said organic acid is 0.29 mole/L to 4.71 mole/L, 0.37 mole/L to 3.23 mole/L and 0.026 mole/L to 0.76 mole/L respectively.

6. A process as defined in claim 5 wherein said alkali source comprises ammonium hydroxide.

7. A process as defined in claim 6 wherein said organic acid is citric acid.

8. A process as defined in claim 7 where said hydrogen peroxide is formed in situ from a perborate.

9. A process as defined in claim 8 wherein the concentration of hydrogen peroxide, said alkali source and said organic acid is 0.59 mole/L to 4.71 mole/L, 0.37 mole/L to 3.23 mole/L and 0.05 mole/L to 0.66 mole/L respectively.

* * * * *